United States Patent [19]

Kurze et al.

[11] 4,268,402

[45] May 19, 1981

[54] LIQUEFACTION OF AQUEOUS TEXTILE SOFTENERS

[75] Inventors: Joachim Kurze, Hirschberg; Rolf Fikentscher, Ludwigshafen; Georg Krusche, Frankenthal, all of Fed. Rep. of Germany

[73] Assignee: BASF Aktiengesellschaft, Fed. Rep. of Germany

[21] Appl. No.: 76,413

[22] Filed: Sep. 17, 1979

[30] Foreign Application Priority Data

Sep. 21, 1978 [DE] Fed. Rep. of Germany ..... 2841076

[51] Int. Cl.[3] ..... D06M 13/36; D06M 13/46

[52] U.S. Cl. ..... 252/8.8; 8/137; 260/404.5

[58] Field of Search ..... 252/8.8; 260/404, 404.5 Q, 260/404 R

[56] References Cited

U.S. PATENT DOCUMENTS

| | | | |
|---|---|---|---|
| 3,984,335 | 10/1976 | Ciko et al. | 252/8.8 |
| 4,060,505 | 11/1977 | Ciko et al. | 252/8.8 |
| 4,092,253 | 5/1978 | Cuntze et al. | 252/8.8 |
| 4,115,281 | 9/1978 | Ciko et al. | 252/8.8 |
| 4,118,324 | 10/1978 | Steckelberg et al. | 252/8.8 |
| 4,129,506 | 12/1978 | Wallhausser et al. | 252/8.8 |

FOREIGN PATENT DOCUMENTS 842842 1/1959 United Kingdom .

OTHER PUBLICATIONS

Chem. Abs. 90:88703y, "Liquid Aq. Textile Softener", Kurze et al., Dec. 14, 1978, Abst. of Ger. Off. DT2722079.

*Primary Examiner*—Joseph L. Schofer
*Assistant Examiner*—Herbert J. Lilling
*Attorney, Agent, or Firm*—Keil & Witherspoon

[57] ABSTRACT

Aqueous textile softeners containing as active ingredient a condensate of 1 mole of a bis- or tris-hydroxyalkylamine of the formula

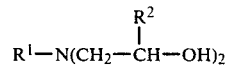

where $R^1$ is H, alkyl of 1 to 4 carbon atoms, hydroxyethyl or 2-hydroxypropyl and $R^2$ is H or $CH_3$, with from 0.8 to 2 moles of a fatty acid of 16 to 18 carbon atoms, the said condensate being in the form of a salt with an inorganic or organic acid or being partially or completely quaternized at the amine nitrogen, cannot readily be formed into liquids containing 10% or more of active ingredient.

According to the invention liquids containing from 15 to 40% by weight of such an active ingredient can be formed by adding from 3 to 15% by weight based on the active ingredient of a compound of the formula II

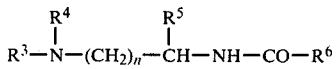

where n is an integer from 1 to 4, $R^3$ and $R^4$ independently of one another are methyl, ethyl or propyl, $R^5$ is hydrogen or methyl and $R^6$ is alkyl of 7 to 13 carbon atoms including a chain of at least 7 carbon atoms, as a salt of an inorganic or organic watersoluble acid, and bringing the pH of the formulation to 2.5 to 6. The softeners of the invention are used after dilution for softening textiles.

10 Claims, No Drawings

LIQUEFACTION OF AQUEOUS TEXTILE SOFTENERS

The present invention relates to the liquefaction of inherently pasty aqueous textile softeners based on hydroxylalkylamine-fatty acid condensates.

It has long been customary to finish cellulosic or synthetic fibers, filaments or yarns with a softener in order to allow them to be converted to woven or knitted fabrics, or to treat textiles, after washing or dyeing and especially after resin finishing, with a softener in order to achieve a smooth, pleasant hand. Many softeners have been disclosed. For example, certain very effective aqueous textile softeners contain, as the active ingredient, a condensate of 1 mole of a hydroxyalkylamine of the formula I defined below with from 0.8 to 2 moles of a fatty acid of 16 to 18 carbon atoms (of which fatty acid up to about 50 mole % can be unsaturated, and up to 20 mole % can consist of shorter-chain fatty acids, especially of 8 to 14 carbon atoms, for example coconut fatty acid) in acid solution or in the form of quaternary ammonium salts. The condensates essentially consist of a mixture of the corresponding amides and esters and of the esters of simultaneously produced hydroxyalkyl-piperazine derivatives. On working these condensates into a paste with boiling water in the presence of inorganic or organic acids, aqueous formulations are obtained which, if they contain from 10 to 30 percent by weight of active ingredient, are a stiff paste, i.e. highly viscous and not pourable, at room temperature, and cannot be diluted to the use concentration with cold water.

If attempts are made to lower the viscosity of these aqueous stiff paste formulations by adding a surfactant, and thereby to make the formulations easier to handle, a moderate effect is achieved, according to the prior art, only when using relatively large amounts (from 20 to 30% by weight, based on active softener ingredient) of a non-ionic oxalkylation product of the type of alcohols of 9 to 15 carbon atoms condensed with from 10 to 20 moles of a mixture of ethylene oxide and propylene oxide (compare Table 1, Comparative Examples 2–6). The products, only some of which are initially pourable, however tend to thicken on storage. Furthermore, the addition of these non-ionic oxyalkylation products has an adverse effect on the excellent softening action of the said fatty acid/hydroxyalkylamine condensates on cellulosic and synthetic fibers.

The present invention seeks to provide a means of liquefying the said softening agents without substantially impairing their softening action.

According to the present invention there is provided a process for liquefying an aqueous textile softener which contains, as active ingredient, from 15 to 40 percent by weight of a condensate of 1 mole of a bis- or tris-hydroxyalkylamine of the formula $$R^1-N(CH_2-\overset{\overset{R^2}{|}}{CH}-OH)_2 \qquad \text{I}$$

where $R^1$ is H, alkyl of 1 to 4 carbon atoms, hydroxyethyl or 2-hydroxypropyl and $R^2$ is H or $CH_3$, with from 0.8 to 2 moles of a fatty acid of 16 to 18 carbon atoms, the said condensate being in the form of a salt with an inorganic or organic acid or being partially or completely quaternized at the amine nitrogen, wherein there is added to the softener from 3 to 15 percent by weight, based on the said active ingredient, of a compound of the formula $$R^3-\overset{\overset{R^4}{|}}{N}-(CH_2)_n-\overset{\overset{R^5}{|}}{CH}-NH-CO-R^6 \qquad \text{II}$$

where n is an integer from 1 to 4, $R^3$ and $R^4$ independently of one another are methyl, ethyl or propyl, $R^5$ is hydrogen or methyl and $R^6$ is alkyl of 7 to 13 carbon atoms including a chain of at least 7 carbon atoms, as a salt with an inorganic or organic water-soluble acid, and the pH of the formulation is brought to 2.5 to 6.

It is true that similar mixtures have already been described in British Patent Specification No. 842,842. However, they differ from the mixtures to be used according to the invention, firstly in respect of the ratios employed, secondly in respect of the nature of one of the components, since in the said British specification the N-(ω-dialkylaminoalkyl)-fatty acid amides (formula II as defined above) are quaternized, in contrast to those to be employed according to the invention, and finally in that the said publication contains no indication that the softener can be liquefied by adding small amounts of component II thereto. On the contrary, the Examples in the British specification speak of "firm pastes" which only give solutions on dilution with water to 0.1% by weight strength (at which concentration the solutions are still opalescent). Accordingly, the success of the present invention in liquefying the softeners in question is also surprising in the light of this publication.

The carboxylic acid component ($R^6COOH$) for the preparation of the "liquefier" of the formula II basically is selected from caprylic, pelargonic, capric, undecylic, tridecylic, lauric and myristic acids, of which the last two are preferred, and their mixtures, especially hardened or non-hardened coconut fatty acid. The presence of a total of up to about 30, preferably less than 20, percent by weight of one or more unsaturated acids and of one or more acids of fewer than 8 or more than 14 carbon atoms does not impair the liquefaction effect. However, because of some danger of yellowing, saturated acids are preferred. It may be noted that the acids of fewer than 8 or more than 14 carbon atoms contribute little or nothing to the liquefying action.

The other starting component for the preparation of II, i.e. $R^3R^4N(CH_2)_2CHR^5NH_2$ is an asymmetrically substituted alkylenediamine. Amongst these, dimethylaminopropylamine and diethylaminopropylamine are preferred and can be prepared, for example, by adduct formation of dimethylamine or diethylamine with acrylonitrile, followed by hydrogenation of the nitrile group. A dialkylaminoethylamine can be prepared, for example, by reaction of the dialkylamine with ethyleneimine. The analogous reaction with propyleneimine gives the corresponding methyl derivative. A general method of obtaining unsymmetrically substituted alkylenediamines starts from the corresponding unsubstituted alkylenediamine, which is monoacylated, dialkylated at the amino group which remained free, and then hydrolyzed. These and other methods of preparation form part of the prior art.

The condensation of the components mentioned to form the compound II may be carried out in a conventional manner, with or without an acid catalyst and with removal of the water of reaction. The condensation may for example be carried out in a melt, in which case the reaction mixture is heated to a sufficiently high temperature for the water formed during the reaction to be removed easily. Preferred temperatures are from 120° to 200° C. The water of reaction can be removed by use of reduced pressure, by an inert gas or by azeotropeforming substances such as aromatic or aliphatic hydrocarbons, e.g. benzene, xylene, toluene or gasoline.

Water-soluble, preferably monobasic, inorganic or organic acids are employed for forming salts of the compounds II. For economic reasons, cheap acids manufactured on a large industrial scale, such as hydrochloric acid, formic acid and acetic acid, are preferred. The acid is generally employed in such amount that a 2% strength aqueous solution of the salt has a pH of from 2.5 to 6, preferably from 3 to 5. At a higher pH, the liquefying effect diminishes substantially, whilst lower pH values are unnecessary.

The amount of liquefier of the formula II is from 3 to 15 percent by weight, based on the active ingredient of the softener. These relatively small amounts have only a slight effect on the softening action.

The active ingredient of the softener may be obtained by condensation (by conventional methods, for example analogously to the method described above for the liquefier II) of an appropriate alkanolamine, e.g. diethanolamine or triethanolamine, di-i-propanolamine or tri-i-propanolamine, or an N-$C_{1-4}$-alkyldiethanolamine or an N-$C_{1-4}$-alkyl-di-i-propanol amine, with an unsaturated or, preferably, saturated fatty acid of 16 to 18 carbon atoms or a fatty acid mixture which contains at least 80, preferably at least 90, percent by weight of such fatty acids, using, for the condensation, a molar ratio of amine:fatty acid of from 1:0.8 to 1:2, preferably from 1:0.9 to 1:1.3. Here again, the same acids may be used for forming the salt as are used in the case of the liquefier. If the hydroxylamine-fatty acid condensate is to be quaternized, conventional alkylating agents, especially dimethyl sulfate or diethyl sulfate, methyl chloride, benzyl chloride or sodium chloroacetate, may be employed, in the conventional manner, in most cases in the presence of water. In the case of the chloroacetate, an inner salt results.

The conventional softener solution, without the liquefying additive employed according to the invention, can advantageously be prepared as follows: the condensate is fused and treated with acid or quaternized, the product is worked into a paste with about 4 times its amount by weight of boiling water and the mixture is stirred for 10 minutes at about 95° C. and cooled slowly, whilst stirring.

To prepare the liquid textile softener in accordance with the invention, it is possible simply to fuse together the active ingredient of the softener and the liquefier II and then to proceed further as has been described. Of course, other methods can also be used; for example, it is possible to prepare the aqueous solutions of the salts separately and then mix them, but this is more involved and offers no advantage.

The formulations obtainable according to the invention are distinguished by their liquid consistency and hence their greater ease of handling and metering, and by their solubility in cold water, when compared to the conventional softeners based on the same materials. These features offer the textile processor advantages which must not be underestimated.

The products may be used in the manner conventionally employed for softeners; thus, textile goods can for example be treated with aqueous formulations of the softeners of a concentration of from 0.1 to 1.5 g of active ingredient per liter, using a long liquor, or of from 1 to 10 g of active ingredient per liter, using a short liquor on a padder, with the pH of the liquor from 2.5 to 6, preferably from 3 to 5. Active ingredient here means the mixture of the active ingredient of the softener (fatty acid condensate of I) and the liquefier II. The goods may then be centrifuged or squeezed off, and dried, in the conventional manner.

It is also possible to use a softener obtained according to the invention conjointly with one or more other non-ionic or cationic textile treatment agents, for example basic dyes for dyeing polyacrylonitrile fibers, and, preferably, conjointly with resin finishing agents or wrinkle-resist finishes, especially aminoplast intermediates. The last-mentioned combined method of use is particularly appropriate where the textile goods contain, or consist of, cellulose.

Aminoplast intermediates are low molecular weight urea or melamine derivatives which, because of their N-methylol or N-methoxymethyl groups, can react, on heating, with themselves or with other hydroxyl-containing compounds, forming the actual aminoplasts. The conventional conditions of use of these known materials can as a rule be retained without modification.

Examples of other assistants which may be employed simultaneously with the softeners obtained according to the invention are levelling agents, wetting agents and dressings. These may be used as solutions or dispersions. It is only anionic substances which cannot as a rule be employed in the same bath as the softener formulations obtained according to the invention.

In the following Examples, percentages are by weight. Tests employed in the Examples:

Pourability: The sample is stored for 24 hours in a 50 ml penicillin tube at +10° C. The sample is then examined as to whether it is still easily pourable at this temperature.

The viscosity is measured, after 24 hours' storage at 20° C., in a 100 ml Ford cup with a 4 mm orifice, the flow time in seconds being recorded.

Softening action:

Grey high-bulk polyacrylonitrile, 2×35.7 tex, shrunk and washed, or cotton yarn, 2×29.4 tex, scoured and bleached, is treated, using a liquor ratio of 30:1, with 0.2 g/l of active ingredient of the softener formulations shown in Tables 1 and 2, for fifteen minutes at pH 5 and 45° C.; it is then centrifuged to 50% residual moisture (in the case of polyacrylonitrile) or 100% residual moisture (in the case of cotton), dried at 80° C. and conditioned at 20° C. and 65% relative humidity for 48 hours.

Cotton fabric (poplin shirting, weighing 120 g/m$^2$) is impregnated on a padder with a liquor containing 125 g/l of a 50% strength aqueous solution of N,N'-dimethylol-4,5-dihydroxy-ethyleneurea, 15 g/l of $MgCl_2 \cdot 6H_2O$ and 6 g/l of the active ingredient of the softener formulations A to J shown in Tables 1 and 2. The pH of the liquor is 5 to 5.5, and the wet pick-up is 80%. The fabric is then dried on a tenter at 100° C., condensed for 3 minutes at 160° C. and then conditioned for 48 hours.

A 50:50 cotton/polyester union fabric weighing 130 g/m$^2$ is impregnated on a padder with a liquor containing 80 g/l of a 50% strength aqueous solution of N,N'-dimethylol-4,5-dihydroxy-ethyleneurea, 10 g/l of $ZnCl_2$ and 4 g/l of active ingredient of the softener formulations A to J shown in Tables 1 and 2. The pH of the liquor is 5 and the wet pick-up is 70%. The fabric is then dried on a tenter at 100° C., condensed for 4 minutes at 150° C. and then conditioned for 48 hours.

The softening effect is assessed, from the resulting hand, by 6 persons.

Liquefier (II):

(a) The 3-dimethylaminopropylamide of hardened coconut fatty acid (composition of the fatty acid: about 7% of $C_8$; about 7% of $C_{10}$; about 48% of $C_{12}$; about 18% of $C_{14}$; about 8% of $C_{16}$; about 11% of $C_{18}$)

(b) The 3-dimethylaminopropylamide of lauric acid (c) The 3-dimethylaminopropylamide of myristic acid (d) The 3-diethylaminopropylamide of hardened coconut fatty acid (e) The amide obtained from 4-diethylamino-1-methylbutylamine and hardened coconut fatty acid Fatty acid/alkanolamine condensates (softeners) which are to be liqufied:

(A) A condensate of 1 mole of technical-grade stearic acid (average molecular weight 273) and 1 mole of technical-grade triethanolamine; acid number 0.5 mg of KOH/g of substance.

(B) (Condensate 1), quaternized with 0.9 mole of dimethyl sulfate; an aqueous formulation containing 90% of active ingredient.

(C) (Condensate 1), quaternized with 1 mole of sodium chloroacetate; an aqueous formulation containing 25% of active ingredient.

(D) A condensate of 1.3 moles of technical-grade stearic acid and 1 mole of triisopropanolamine (acid number 2.5 mg of KOH/g of condensate), quaternized with 0.9 mole of dimethyl sulfate; an aqueous formulation containing 30% of active ingredient.

(E) A condensate of 1 mole of technical-grade stearic acid and 1.1 moles of diethanolamine; acid number 0.9 mg of KOH/g of condensate; total basic N equivalent to 88 mg of KOH/g of condensate; tertiary basic N equivalent to 82 mg of KOH/g of substance.

(F) A condensate of 1 mole of tallow fatty acid (acid number 279 mg of KOH/g; iodine number 58 g of iodine/100 g) and 1 mole of diethanolamine; acid number 3.9 mg of KOH/g of condensate; total basic N equivalent to 75 mg of KOH/g of condensate; tertiary basic N equivalent to 71 mg of KOH/g of condensate.

(G) A condensate of 1 mole of technical-grade stearic acid and 1.1 moles of diisopropanolamine; acid number 1 mg of KOH/g of condensate; total basic N equivalent to 64 mg of KOH/g of condensate.

(H) A condensate of 1.2 moles of technical-grade stearic acid and 1 mole of N-methyldiethanolamine; acid number 3.6 mg of KOH/g of condensate; total basic N equivalent to 129 mg of KOH/g of condensate.

(J) A condensate of 1.2 moles of technical-grade stearic acid and 1 mole of N-methyldiethanolamine, quaternized with 1 mole of sodium chloroacetate; and aqueous formulation containing 22% of active ingredient.

Condensates A and E to H are undiluted (100% active ingredient).

The pasty products in Comparative Examples 1 and 7 to 14 (Table 1) have a very good softening and smoothing action on the textile substrates. The addition of oxyalkylated fatty alcohols and alkylphenols to the fatty acid/alkanolamine condensates (Comparative Examples 2 to 6 of Table 1) results in a substantial deterioration of the hand of the yarns and fabrics, in the sense that it becomes rough, dull and straw-like. This deterioration is observed in spite of the fact that the amount added in no case suffices to meet satisfactorily the purpose of the additive, namely the liquefaction of the softener. By contrast, the very effective addition of the liquefiers according to the invention to the said formulations (Examples 1 to 15 of Table 2) only very slightly detracts from the softening effect.

TABLE 1

| Comparative Examples corresponding to the prior art | | | | |
|---|---|---|---|---|
| Comparative Example | Chemical composition | pH (10 g of product, made up to 100 ml with water) | Viscosity at +10° C., measured after 24 hours | Flow time at +20° C. from a 100 ml Ford cup with 4 mm orifice |
| 1 | 22.2% of B<br>77.8% of water | 3.7 | pasty, not pourable | pasty, cannot be measured |
| 2+ | 22.2% of B<br>5.0% of $C_{11/13}$-oxo-alcohol + 3 EO<br>72.8% of water | 3.5 | " | pasty, cannot be measured |
| 3+ | 22.2% of B<br>5.0% of $C_{13/15}$-oxo-alcohol + 8 EO<br>72.8% of water | 3.5 | still pourable | 46 s |
| 4+ | 22.2% of B<br>5.0% of $C_{13/15}$-oxo-alcohol + (10 EO + 5 PO) as a copolymer<br>72.8% of water | 3.5 | " | 70 s |
| 5+ | 22.2% of B<br>5.0% of $C_{13/15}$-oxo-alcohol + (10 EO + 5 PO) as a block polymer<br>72.8% of water | 3.5 | still pourable | 63 s |
| 6+ | 22.2% of B<br>5.0% of nonylphenol + 6 EO<br>72.8% of water | 3.5 | " | 63 s |
| 7 | 20.0% of A<br>1.5% of formic acid (85% strength)<br>78.5% of water | 3.9 | pasty, not pourable | pasty, cannot be measured |

TABLE 1-continued

| Comparative Examples corresponding to the prior art | | | | |
|---|---|---|---|---|
| Comparative Example | Chemical composition | pH (10 g of product, made up to 100 ml with water) | Viscosity at +10° C., measured after 24 hours | Flow time at +20° C. from a 100 ml Ford cup with 4 mm orifice |
| 8 | 80% of C<br>20% of water | 3.6 | " | pasty, cannot be measured |
| 9 | 66.7% of D<br>33.3% of water | 3.9 | " | pasty, cannot be measured |
| 10 | 20% of E<br>2% of glacial acetic acid (98% strength)<br>78% of water | 4.5 | " | pasty, cannot be measured |
| 11 | 20% of F<br>2% of glacial acetic acid (98% strength)<br>78% of water | 4.1 | pasty, not pourable | pasty, cannot be measured |
| 12 | 20% of G<br>2% of glacial acetic acid (98% strength)<br>78% of water | 3.9 | " | pasty, cannot be measured |
| 13 | 20% of H<br>1.3% of formic acid (85% strength)<br>78.7% of water | 3.6 | " | 72 s |
| 14 | 91% of J<br>1% of glacial acetic acid (98% strength)<br>8% of water | 4.0 | " | " |

+brought to pH 3.5 with dilute formic acid
EO = ethylene oxide PO = propylene oxide

TABLE 2

| Examples aceording to the invention | | | | |
|---|---|---|---|---|
| Example | Chemical composition | pH (10 g of product, made up to 100 ml with water) | Viscosity at +10° C., measured after 24 hours | Flow time at +20° C. from a 100 ml Ford cup with 4 mm orifice |
| 1 | 22.2% of B<br>1% of a<br>0.5% of formic acid (85% strength)<br>76.3% of water | 3.3 | low viscosity, easily pourable | 17 s |
| 2 | 22.2% of B<br>2% of a<br>0.5% of formic acid (85% strength)<br>75.3% of water | 3.5 | low viscosity, easily pourable | 14 s |
| 3 | 22.2% of B<br>3% of a<br>0.5% of formic acid (85% strength)<br>74.3% of water | 3.6 | low viscosity, easily pourable | 13 s |
| 4 | 22.2% of B<br>2% of b<br>0.5% of formic acid (85% strength)<br>75.3% of water | 3.5 | low viscosity, easily pourable | 11 s |
| 5 | 22.2% of B<br>2% of c<br>0.5% of formic acid (85% strength)<br>75.3% of water | 3.4 | low viscosity, easily pourable | 12 s |
| 6 | 22.2% of B<br>2% of d<br>0.5% of formic acid (85% strength)<br>75.3% of water | 3.4 | low viscosity, easily pourable | 13 s |
| 7 | 22.2% of B<br>2% of e<br>0.5% of formic acid (85% strength)<br>75.3% of water | 3.3 | low viscosity, easily pourable | 20 s |
| 8 | 20% of A | 3.4 | low viscosity, | 33 s |

TABLE 2-continued

| Example | Chemical composition | pH (10 g of product, made up to 100 ml with water) | Viscosity at +10° C., measured after 24 hours | Flow time at +20° C. from a 100 ml Ford cup with 4 mm orifice |
|---|---|---|---|---|
| | Examples according to the invention | | | |
| | 2% of a<br>2% of formic acid<br>(85% strength)<br>74% of water | | easily pourable | |
| 9 | 80% of C<br>2% of a<br>0.5% of formic acid<br>(85% strength)<br>17.5% of water | 3.7 | low viscosity, easily pourable | 17 s |
| 10 | 66.7% of D<br>2% of a<br>0.3% of formic acid<br>(85% strength)<br>31% of water | 4.1 | low viscosity, easily pourable | 19 s |
| 11 | 20% of E<br>2% of a<br>2% of acetic acid<br>(85% strength)<br>76% of water | 4.7 | low viscosity, easily pourable | 13 s |
| 12 | 20% of F<br>2% of a<br>2% of acetic acid<br>(98% strength)<br>76% of water | 4.3 | low viscosity, easily pourable | 12 s |
| 13 | 20% of G<br>2% of a<br>2% of acetic acid<br>(98% strength)<br>76% of water | 4.0 | low viscosity, easily pourable | 21 s |
| 14 | 20% of H<br>2% of a<br>1.5% of formic acid<br>(85% strength)<br>76.5% of water | 3.6 | low viscosity, easily pourable | 12 s |
| 15 | 91% of J<br>2% of a<br>1% of acetic acid<br>(98% strength)<br>6% of water | 4.1 | low viscosity easily pourable | 15 s |

We claim:

1. A process for liquefying an aqueous textile softener which contains, as the active ingredient, from 15 to 40 percent by weight of a condensate of 1 mole of a bis- or tris-hydroxyalkylamine of the formula $$R^1-N(CH_2-\overset{\overset{R^2}{|}}{C}H-OH)_2 \qquad \text{I}$$

where $R^1$ is H, alkyl of 1 to 4 carbon atoms, hydroxyethyl or 2-hydroxypropyl and $R^2$ is H or $CH_3$, with from 0.8 to 2 moles of a fatty acid of 16 to 18 carbon atoms, the said condensate being in the form of a salt with an inorganic or organic acid or being partially or completely quaternized at the amine nitrogen, wherein there is added to the softener from 3 to 15 percent by weight, based on the said active ingredient, of a compound of the formula $$R^3-\overset{\overset{R^4}{|}}{N}-(CH_2)_n-\overset{\overset{R^5}{|}}{C}H-NH-CO-R^6 \qquad \text{II}$$

where n is an integer from 1 to 4, $R^3$ and $R^4$ independently of one another are methyl, ethyl or propyl, $R^5$ is hydrogen or methyl and $R^6$ is alkyl of 7 to 13 carbon atoms including a chain of at least 7 carbon atoms, as a salt with an inorganic or organic water-soluble acid, and the pH of the formulation is brought to 2.5 to 6.

2. The process of claim 1 wherein the compound II is derived from lauric or myristic acid and dimethylaminopropylamine or diethylaminopropylamine.

3. The process of claim 1 or 2 wherein the compound II is employed as a salt with hydrochloric, formic or acetic acid, the acid being used in an amount such that a 2% aqueous solution of the salt has a pH of from 2.5 to 6.

4. The process of claims 1 or 2, wherein the softener is prepared by fusing the active ingredient with compound II and treating with acid, working the product into a paste with water, stirring at elevated temperature and cooling whilst stirring.

5. A liquid textile softener obtained by the process of claims 1 or 2.

6. A liquid textile softener obtained by the process of claim 2.

7. A method of imparting softness to textile goods wherein the goods are treated with the textile softener of claim 5 in water.

8. The method of claim 7 wherein the softener is used conjointly with one or more other non-ionic or cationic textile treatment agents.

9. Textile goods which have been treated by the method of claim 7.

10. Textile goods which have been treated by the method of claim 8.

* * * * *